US008628275B1

(12) United States Patent
Trader et al.

(10) Patent No.: US 8,628,275 B1
(45) Date of Patent: Jan. 14, 2014

(54) STRUCTURAL BONDED REPAIR METHOD FOR REPAIRING TUBULAR MEMBERS IN AN OFFSHORE MARINE ENVIRONMENT

(75) Inventors: Bruce Trader, Slidell, LA (US); George Hofmeister, Lafayette, LA (US)

(73) Assignee: Madcon Corporation, Pearl River, LA (US)

( * ) Notice: Subject to any disclaimer, the term of this patent is extended or adjusted under 35 U.S.C. 154(b) by 261 days.

(21) Appl. No.: 13/018,891

(22) Filed: Feb. 1, 2011

Related U.S. Application Data

(60) Provisional application No. 61/300,335, filed on Feb. 1, 2010.

(51) Int. Cl.
*E02D 5/64* (2006.01)

(52) U.S. Cl.
USPC ..... 405/216; 405/211

(58) Field of Classification Search
USPC ..... 405/195.1, 211, 211.1, 216; 138/97–99; 166/277
See application file for complete search history.

(56) References Cited

U.S. PATENT DOCUMENTS

| | | | | |
|---|---|---|---|---|
| 967,952 | A | 8/1910 | Moran | |
| 4,023,374 | A | 5/1977 | Colbert et al. | |
| 4,068,483 | A | 1/1978 | Papworth | |
| 4,091,301 | A | 5/1978 | Blank | |
| 4,114,388 | A | 9/1978 | Straub | |
| 4,306,821 | A | 12/1981 | Moore | |
| 4,876,896 | A | 10/1989 | Snow et al. | |
| 4,892,410 | A | 1/1990 | Snow et al. | |
| 4,993,876 | A | 2/1991 | Snow et al. | |
| 5,380,131 | A | 1/1995 | Crawford | |
| 5,388,317 | A | 2/1995 | Johansen et al. | |
| 5,395,972 | A | 3/1995 | Furutani | |
| 5,591,265 | A | 1/1997 | Tusch | |
| 5,722,463 | A | 3/1998 | Smyth et al. | |
| 6,536,991 | B1 | 3/2003 | Trader et al. | |
| 6,997,260 | B1 * | 2/2006 | Trader et al. | 166/277 |

FOREIGN PATENT DOCUMENTS

| | | |
|---|---|---|
| GB | 2255583 | 11/1992 |
| JP | 61010634 | 1/1986 |
| JP | 61155521 | 7/1986 |
| JP | 2140322 | 5/1990 |

* cited by examiner

*Primary Examiner* — Tara M. Pinnock
(74) *Attorney, Agent, or Firm* — Garvey, Smith, Nehrbass & North, L.L.C.; Charles C. Garvey, Jr.; Julia M. FitzPatrick

(57) ABSTRACT

A method and apparatus for repairing a tubular member in an offshore marine environment provides a specially configured shell having shell halves, longitudinal seals, and optionally upper and lower seals. Additionally, the shell halves are each provided with a plurality of threaded fasteners that will help with shell alignment, holding the shell rigidly to the tubular member prior to grouting operations.

22 Claims, 12 Drawing Sheets

STRUCTURAL BONDED REPAIR METHOD FOR REPAIRING TUBULAR MEMBERS IN AN OFFSHORE MARINE ENVIRONMENT

CROSS-REFERENCE TO RELATED APPLICATIONS

Priority of U.S. Provisional Patent Application Ser. No. 61/300,335, filed Feb. 1, 2010, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a method and apparatus for repairing a tubular member in an offshore marine environment. More particularly the present invention relates to an improved method and apparatus for repairing a tubular member in a marine environment with a specially configured shell clamped about a damaged area of the tubular member and the annulus between the damaged section and the shell is filled with grout. Inflatable seals can be used to seal the bore of the tubular member if the bore is to be filled with grout in between the inflatable seals.

2. General Background of the Invention

After a hurricane damages an offshore marine platform, the platforms can become weakened to the point where it poses a hazard to safe operation of activities on the platform such as oil and gas well drilling and production activities. In many cases, repair of one or more of the tubular members that form a part of an oil and gas well structure or other offshore structure or platform provides a viable alternative which enables the platform to be used once the repair is completed.

Patents have issued on methods of preparing tubular members on oil and gas wells. Examples include U.S. Pat. Nos. 6,536,991 and 6,997,260 issued to applicants herein. One early patent is the Papworth U.S. Pat. No. 4,068,483 entitled "Protective Sheath for Water-Eroded Wood Piling". In the Papworth patent, the sheath is for a water-eroded wood piling. The sheath is a longitudinally split, flexible and resilient plastic casing with overlapping circumferentially end segments. The casing has a preformed, integral spout at its upper end into which wet concrete can be poured to fill the casing around the eroded section of the piling. Flexible bands clamp the casing tightly around the piling, and the spout has aligned openings in its opposite sides for passing the uppermost one of these bands. The casing may comprise two or more longitudinal sections in overlapped sealed engagement with each other end-to-end for enclosing a long eroded section of the piling.

In the Colbert U.S. Pat. No. 4,023,374, there is disclosed a repair sleeve for a marine pile and a method of applying same. The '374 patent discloses a preformed molded fiberglass resin plastic repair sleeve for use on a marine or other submerged concrete pile and a method of applying the same. The sleeve is provided with at least one vertical seam consisting of inside interlocking reentrant bends which together establish an interlocking tongue and groove joint. The joint is maintained effective by self-tapping screws which are in engaged relation with steel closure clips or strips. The sleeve after assembly is centered about the pile undergoing repair and the continuous space which exists between the sleeve and the pile is filled with a suitable grout which, when hardened, encompasses the internal or inside portions of the joint under pressure and prevents unfastening of the seam. The vertical longitudinal extend of the sleeve is somewhat greater than the water depth of the partially submerged pile to which it is applied and; where a cylindrical concrete pile is concerned, the sleeve is molded on an arcuate bias so as to present an open gap enabling the sleeve to be readily slipped sidewise onto the pile by one or more divers and the gap thereafter closed in order to effect the interlocked joint. Where a square pile is undergoing repair, the sleeve assumes a conformable four-sided shape or, alternatively, it may be formed of two mating right angle sleeve sections having a pair of vertical inside interlocking joints or seams between their adjoining side margins.

The Straub U.S. Pat. No. 4,114,388 discloses a device for protecting a pile from ice formations collecting on it and subsequently abstracting the pile as a result of a variation of tide level including a tapered guard member secured to the pile. The guard member is firmly secured to the c pile by interconnecting stiffening members, horizontal stiffening rings, vertical fin members and compression rings which also serve to prevent deformation of the guard member taper as a result of interaction with the ice formations. The guard member comprises two sections connected by vertically extending tongue and groove joints.

The Moore U.S. Pat. No. 4,306,821 discloses a system for the restoring and reconditioning of structural piling. The system provides an outer form which is attachable to a portion of the piling which has been eroded or corroded and has lost some of its thickness and thus its overall strength. A diameter building filler is placed into the intra form space between the form and the piling, the filler providing a protective and structural coating to that portion of the piling where corrosion or damage has taken place.

Three patents have issued to Richard Snow and Milton Ellisor. These patents include U.S. Pat. Nos. 4,876,896; 4,892,410; and 4,993,876. The '896 and '410 patents discloses a method and apparatus for forming an encapsulation or encasement about a structural member that is said to be suited for use in a marine environment. A two-component polymer system for protective and repair encapsulation is pumpable in two separate strings to the location of the structural member to be encapsulated. The two reactive components are combined in a static mixer immediately prior to being injected within the surrounding translucent jacket. By combining the reactive components immediately prior to use, premature setup is avoided and the resulting grout may be directed to flow upwardly in the jacket for enhancing final properties. By suitable coloring of the components, visual monitoring of the final mixing and distribution in the translucent form or jacket of the encapsulation material may be monitored. A field test for determining bonding strength of the encapsulation polymer to the structural member is also disclosed in the '876 patent and in the '410 patent. The '896 patent discloses a method of testing protective encapsulation of structural members.

Other patents that discuss repair methods are the Fox U.S. Pat. No. 4,091,301 and the Moran U.S. Pat. No. 967,952, both references cited in U.S. Pat. No. 6,536,991 naming applicants herein as inventors. U.S. Pat. No. 6,536,991 is incorporated herein by reference.

Other references that discuss repair methods are the following patents: U.S. Pat. No. 6,997,260: U.S. Pat. Nos. 5,395,972; 5,380,131; 5,388,317; 5,591,265; 5,722,463. Also of possible interest are GB2255583, JP61-155521; JP 6110634; JP2-140322.

BRIEF SUMMARY OF THE INVENTION

The present invention provides a method of structurally repairing or upgrading an underwater or marine member wherein the repairs are affected due to the shear bond strength of a grout product such as an epoxy/polymer grout.

The grout product can be placed in an annulus between the member and a repair mechanism or clamp of improved configuration.

The present invention provides a method and apparatus for repairing a tubular member in an offshore marine environment including a specially configured shell having shell halves, longitudinal seals, and optionally upper and lower seals. Additionally, the shell halves are each provided with a plurality of threaded fasteners that will help with shell alignment, holding the shell rigidly to the tubular member prior to grouting operations, and improve ultimate load capacity after the grout has been placed in a space in between the tubular member and the shell.

In the preferred embodiment, the shear bond strength of the epoxy/polymer grout between the clamp and the member is a range of between about 50 and 500 p.s.i. In some cases, surface preparation of surfaces that will be contacted by grout may include high pressure water (or bubble) blasting, grit blasting, and/or mechanical abrasion.

In the preferred embodiment, the method employs one or more rows of circumferentially and longitudinally spaced threaded fasteners which serve multiple structural functions. First, assisting with initial alignment of the shell, clamp or mechanism annulus spacing. When fully tightened or clamped against the underlying member (e.g. tubular member to be repaired), providing a rigid mechanical connection to insure proper grout placement and bonding while grout is going through its critical initial curing phase transformation from a liquid to a solid (e.g. between about 1 and 7 days or between about ½ and 30 days). After the grout is cured, these threaded fasteners help prevent deflection of the epoxy/polymer grout under load thus improving the shear bond strength and load capacity of the repaired member. In the preferred embodiment, the clamping force of the threaded fastener against the member is in the range of between about 10 and 70 percent yield strength of the fastener, more particularly between about 20 and 70 percent and even more particularly between about 30 and 70 percent of yield strength of the fastener.

Seal clamps placed at each end contain the grout within the repair clamp assembly. These may be used, fabricated for example, of steel and clamped to the member to be repaired and also attached to the repair clamp itself. Alternatively, foam seals saturated with a selected medium such as epoxy may be used as end seals to contain the grout within the repair clamp assembly.

The repair method of the present invention may be used on various shapes such as but not limited to: barrel clamp, K brace, T brace, X brace, Y brace, or as part of other types of clamps.

In the preferred method, the epoxy/polymer grout is placed from the bottom up using plural component batching and pumping equipment (i.e. the components of epoxy resin and hardener).

The method of the present invention can fill the structural member being repaired with grout or it cannot fill the structural member interior with grout.

The grout employed can be cementitious or epoxy.

In one embodiment, an inflatable plug or pig can be inserted inside the member being repaired, preferably two of such plugs or pigs at upper and lower positions. In this fashion, the plugs or pigs isolate the area to be grouted internally (i.e. tubular member bore).

The method of the present invention greatly reduces the installation time and, therefore, the cost as compared to more traditional methods such as post tensioned cementitious grouted clamps and/or wet welding.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
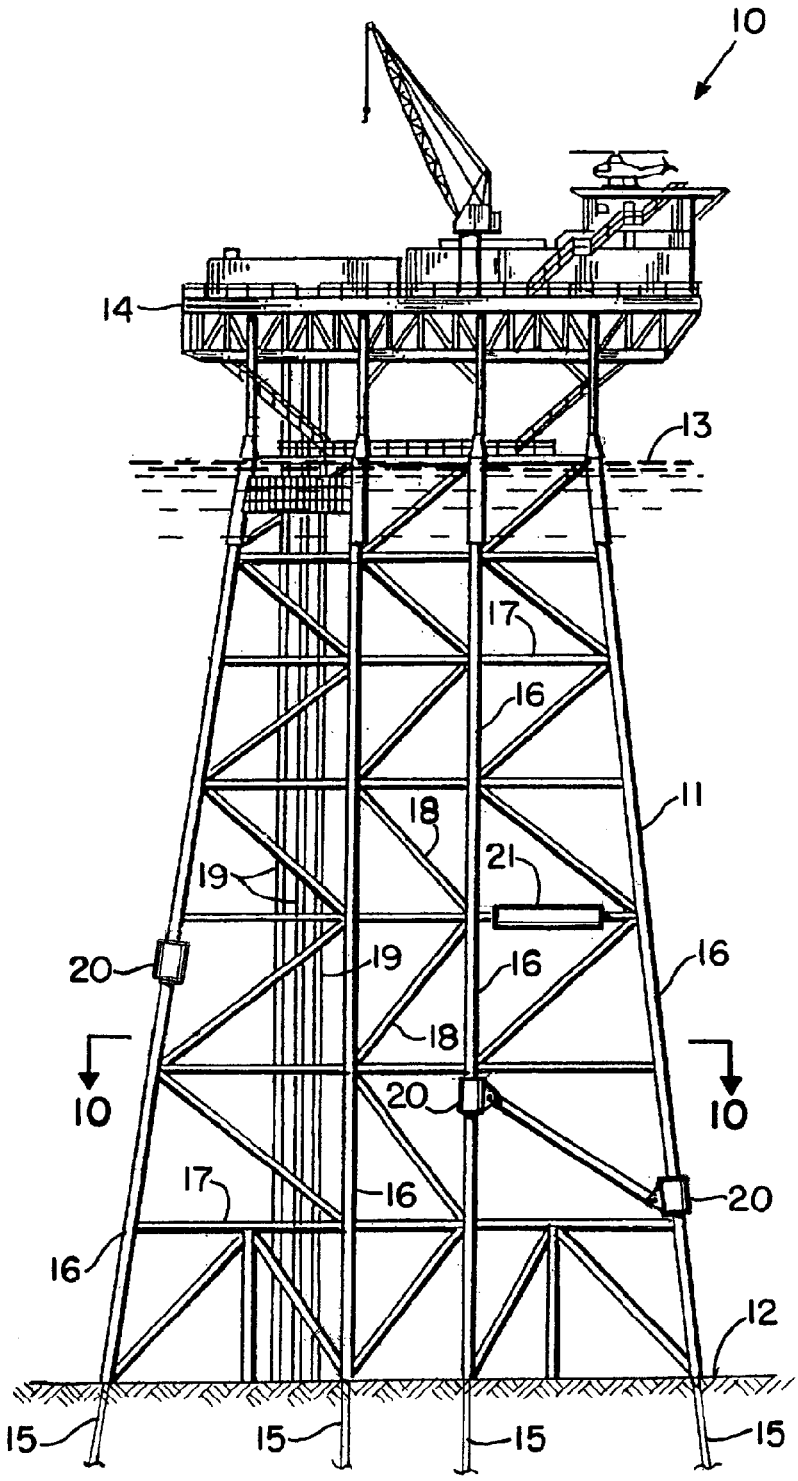
FIG. 1 is an elevation view of the preferred embodiment of the apparatus of the present invention and illustrating the method of the present invention.
Figure 10:
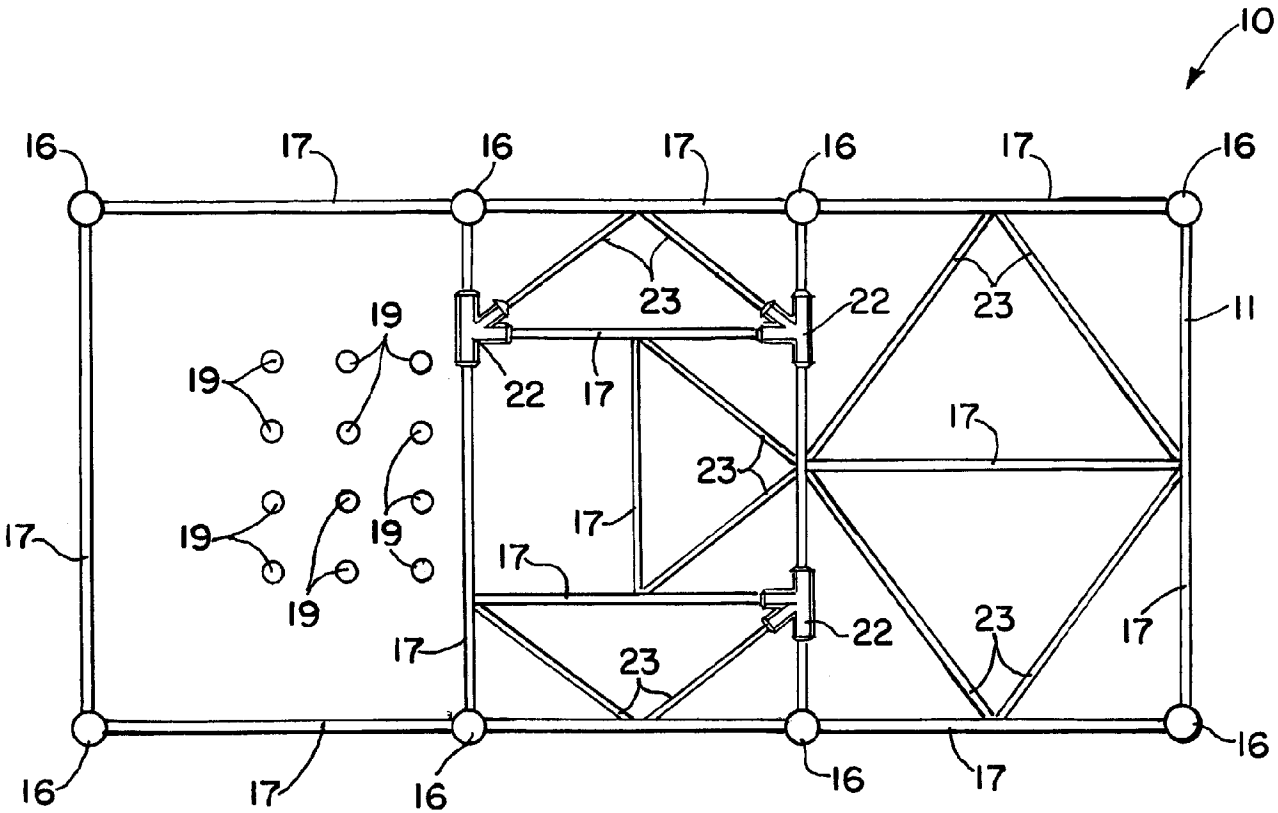
FIG. 10 is a plan view taken along lines 10-10 of FIG. 1.

The marine tubular repair system 10 of the present invention is shown generally in FIGS. 1 and 10. In FIG. 1, a marine jacket 11 is shown. Such jackets 11 are known in the art. They are typically used to support a platform such as an oil and gas well production platform. Jackets 11 can also be used to support drilling platforms. In FIG. 1, the jacket 11 is shown resting on the seabed 12 and extending up to and above water surface 13. In FIG. 1, the marine jacket 11 supports platform 14 which can be an oil and gas drilling platform or an oil and gas well production platform.

Jackets 11 can be anchored to the seabed using a plurality of piling. In FIG. 1, the piling 15 extend through long vertical or inclined tubular members 16 of jacket. Jacket 11 includes other tubular members in addition to the long vertical/inclined tubular members 16. These additional tubular members can include, for example, horizontal tubular member 17, diagonal tubular members 18, and diagonal horizontal tubular members 23.

In FIG. 1, a plurality of risers or riser pipes 19 are shown extending between the seabed 12 and the water surface 13 such pipes can be conduits to oil/gas wells.

A shell or clamp assembly 20 as shown in FIGS. 2-5. Clamp assembly 20 includes a central clamp half section 30 which is mated to another section clamp half section 31. Each of the central clamp half sections 30, 31 provides a curved surface which generally conforms to the outer surface of the tubular member to be repaired. The half section 30 has curved surface 32. The half section 31 has curved surface 33. Each of the central clamp half sections 30, 31 provides a pair or arcuate flanges including upper and lower arcuate flanges. The half section 30 has upper arcuate flange 34 and lower arcuate flange 35. The half section 31 has upper arcuate flange 36 and lower arcuate flange 37. Each of the clamp half sections 30, 31 has linear flanges. The clamp half section 30 has linear flanges 38, 39. The clamp half section 31 has linear flanges 40, 41.

Figure 3:
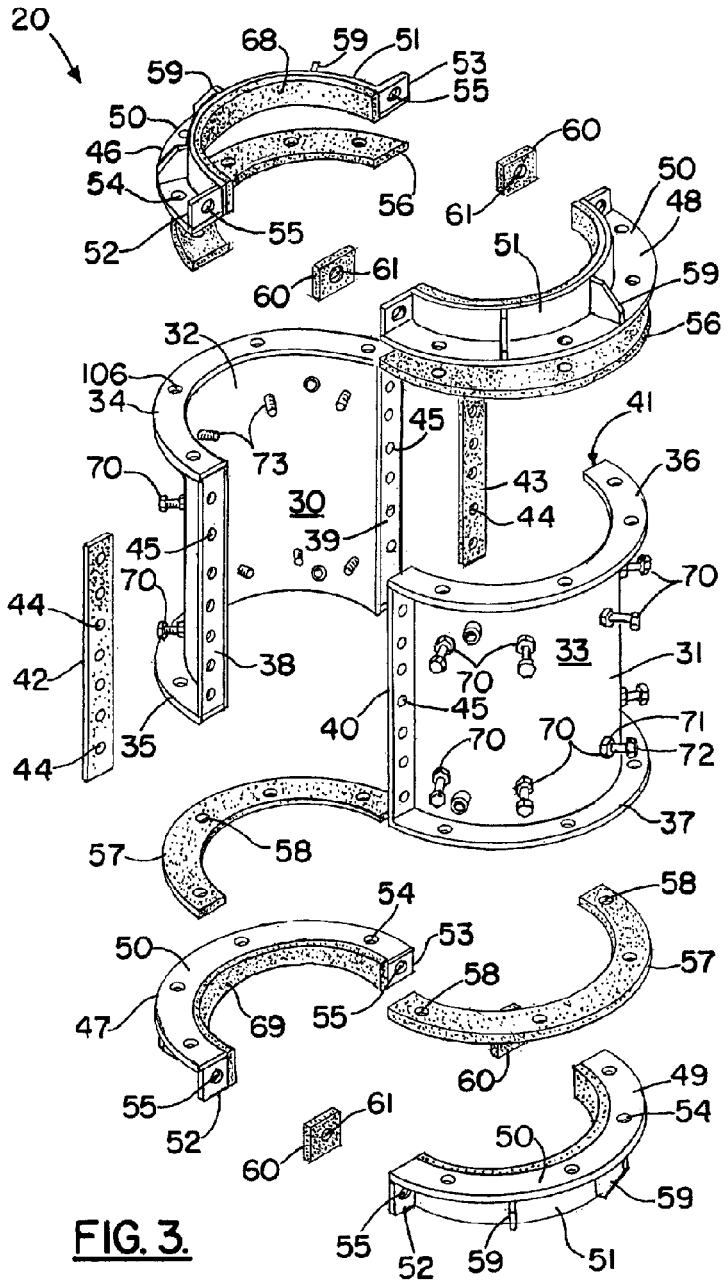
FIG. 3 is a perspective exploded view of the preferred embodiment of the apparatus of the present invention.

A plurality of seals are provided as shown in FIG. 3. These include longitudinal seals 42, 43. The longitudinal seal 42 is sandwiched between linear flanges 38, 40. The seal 43 is sandwiched between linear flanges 39, 41. Each of the longitudinal seals 42, 43 provides seal openings 44 that align with openings 45 of the linear flanges 38-41. In this fashion, fasteners or like connections (e.g. bolted connections) can be inserted through the aligned linear flanges, 38, 40 and 39, 41 as well as through the openings 44 of the seals 42, 43. The seals 42, 43 can be a foam seals saturated with a selected medium such as epoxy material.

A pair of upper clamp half sections and a pair of lower half sections are provided. The upper clamp half sections include upper half sections 46, 48. The lower clamp half sections include lower half sections 47, 49. Each of the clamp half sections 46-49 provides an arcuate plate 50, a curved plate 51, a pair of end plates 52, 53 and can include gussets 59. Arcuate plate 50 and curved plate 51 can be welded together. End plates 52, 53 can also be welded to the combination of arcuate plate 50 and curved plate 51 as shown in FIG. 3. Each of the end plates 52, 53 has an opening 55. Each of the arcuate plates 50 provides openings 54. Each of the upper and lower arcuate flanges 34-37 provides openings 106 that align with the openings 54 of the arcuate plates 50 of the upper and lower half sections 46-49.

End seals 60 (e.g. neoprene seals or foam seals saturated with a selected medium such as epoxy material) are placed in between end plates 52, 53 of the upper clamp half sections 46, 48. Similarly, end seals 60 are placed in between the end plates, 52, 53 of the lower clamp half sections 47, 49 as shown in FIG. 3. In one embodiment the end seals can replace the upper and/or lower clamp half sections, such end seals being foam seals saturated with a medium (e.g. epoxy).

Upper and lower arcuate seals 56, 57 are provided. Upper arcuate seals 56 are placed in between an upper clamp half section 46 or 48 and a central clamp half section 30, 31. Each of the upper and lower arcuate seals 56, 57 provides seal openings 58 that align with the openings 54, 106.

Fastenered connections 62 are used to assemble the central clamp half sections 30, 31 together. Fastenered connections 62 are also used to assemble each of the upper and lower clamp half sections 46-49 to the central clamp half sections 30, 31 and to each other. The central clamp half sections 30, 31 can be connected with a hinge 63 as shown in FIGS. 7 and 8.

Figure 2:
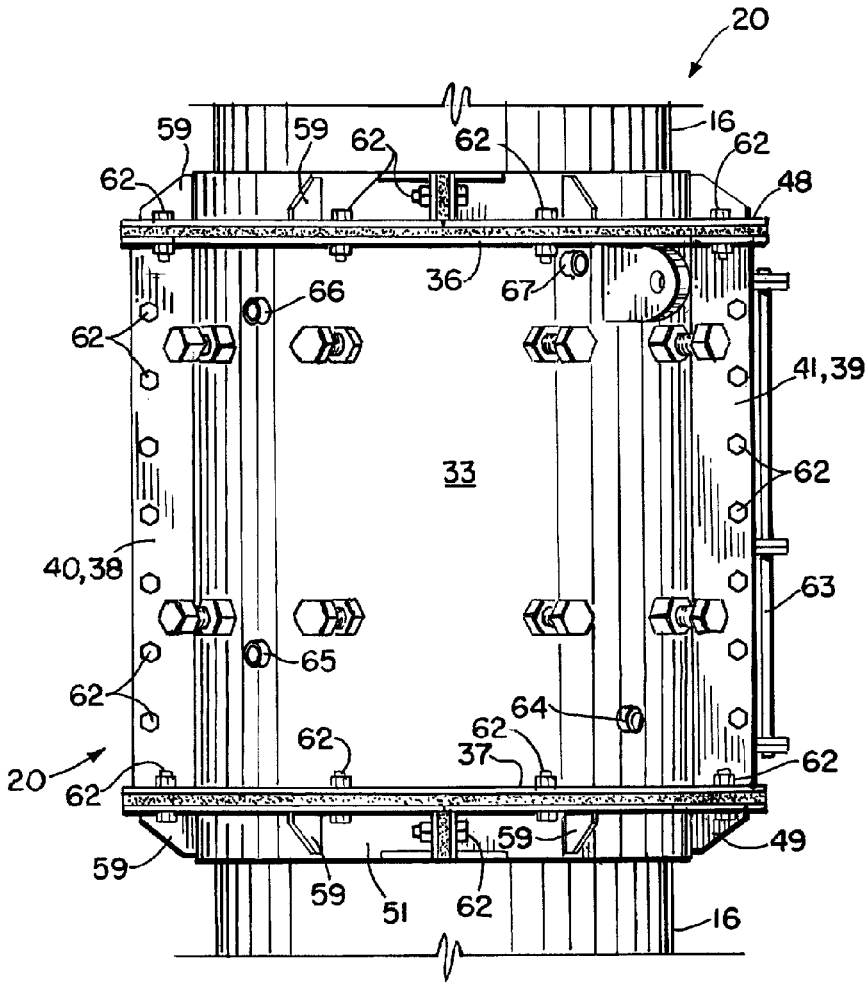
FIG. 2 is a partial elevation view of the preferred embodiment of the apparatus of the present invention and illustrating the method of the present invention.
Figure 5:
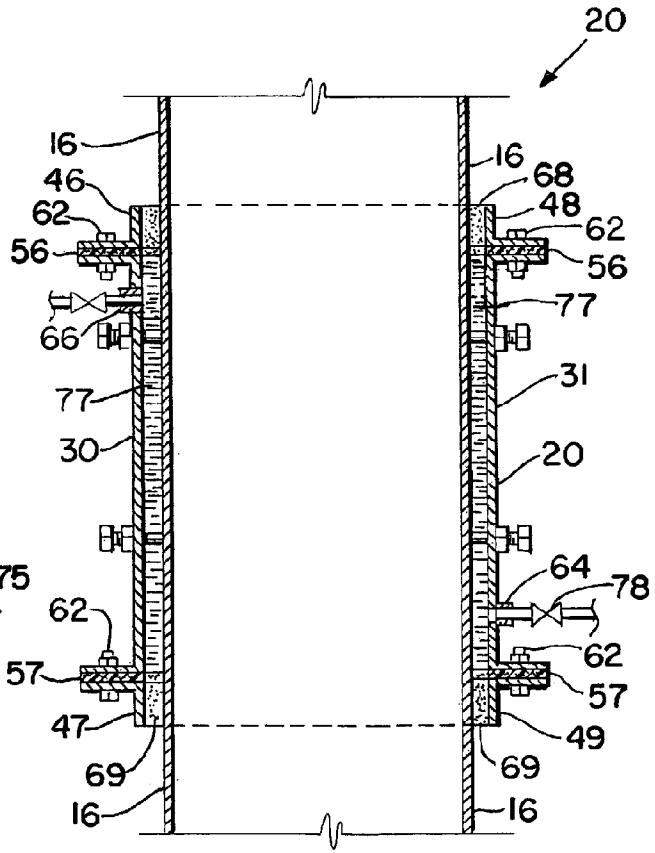
FIG. 5 is a partial sectional elevation view illustrating the method of the present invention and showing the apparatus of the present invention.
Figure 4:
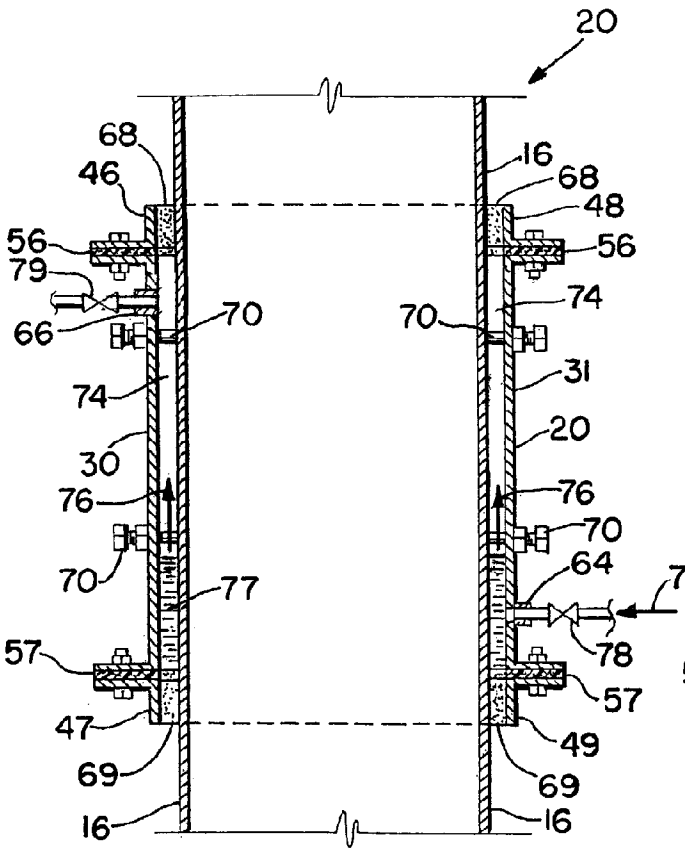
FIG. 4 is a partial sectional elevation view illustrating the method of the present invention and showing the apparatus of the present invention.

Injection ports 64 are provided for adding grout to an annulus 74 that is formed when the apparatus 10 is placed around all or part of a long vertical/inclined tubular 16, a horizontal tubular 17, or diagonal tubular 18. In FIGS. 2, 4 and 5, a lower injection port 64 and a second lower injection port 65 are provided. The ventilation or vent ports 66, 67 are also provided as shown in FIG. 2.

Seals are place in between the upper and lower clamp half sections 46, 47. These include an upper curved seal 68 and a lower curved seal 69 as shown on FIGS. 3 and 4-5. A plurality of threaded fasteners 70 are provided. Each of the threaded fasteners 70 threadably engages an internally threaded fitting 71. Each threaded fastener 70 includes a head 72 and an inner part 73 that extends into annulus 74 and engages the outer surface of a member 16, 17 or 18 to be repaired. This arrangement can be seen in FIGS. 2-5. The threaded fasteners 70 assist with maintaining thickness of the annulus 74 during placement of the shell half sections 30, 31. The threaded fasteners 70 provide a rigid mechanical connection to insure proper grout placement and bonding with the grout while the grout is in the initial curing stage. In FIG. 4, arrow 75 illustrates the injection of grout via a valve line 78 into annulus 74 at injection port 64. Arrow 76 illustrates the gradual flow of grout upwardly in the annulus 74 towards vent ports 66, 67. A valved line 79 is provided at each of the vent ports 66, 67.

Figure 6:
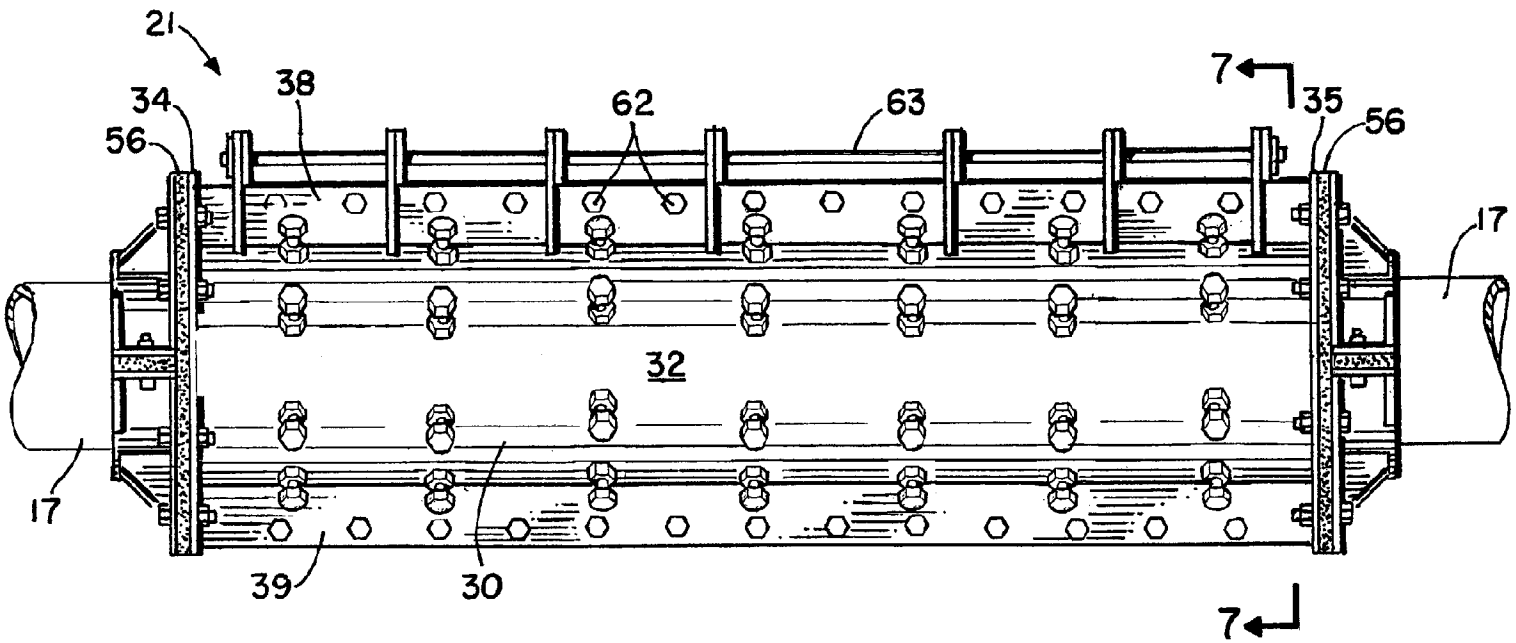
FIG. 6 is an elevation view of the preferred embodiment of the apparatus of the present invention showing a horizontal installation.
Figure 7:
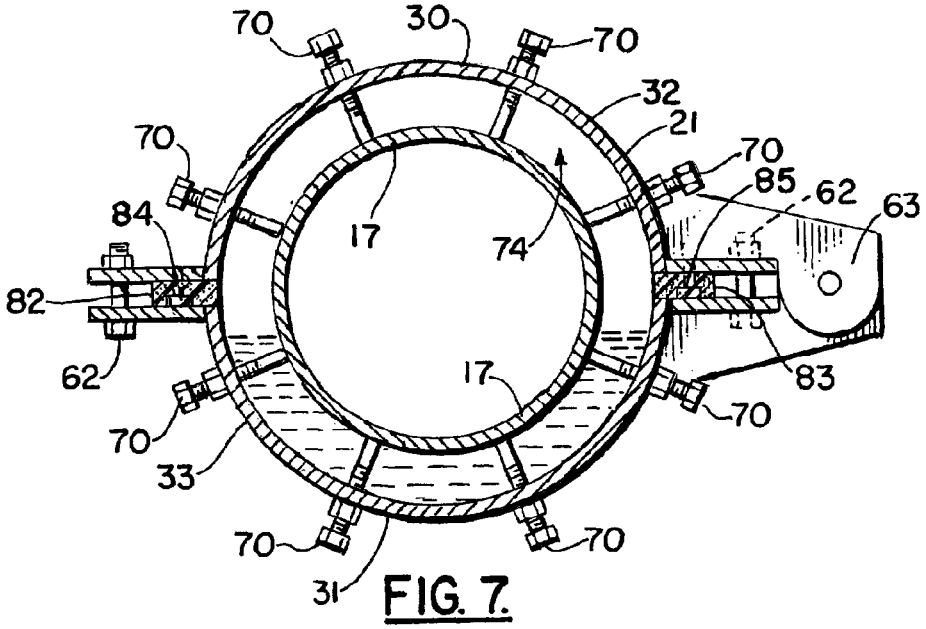
FIG. 7 is a sectional view taken along lines 7-7 of FIG. 6.
Figure 8:
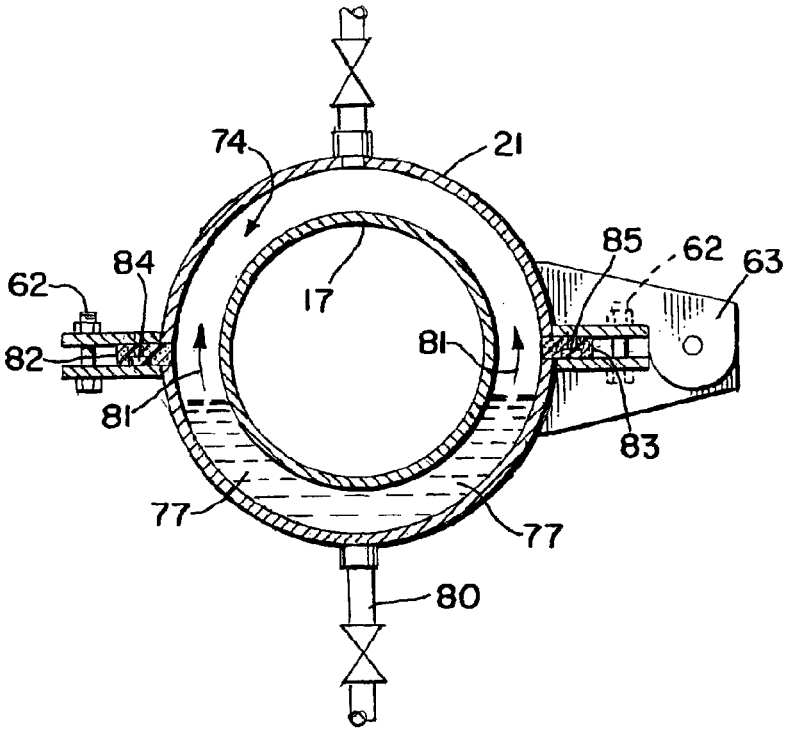
FIG. 8 is an end view of the horizontal repair of FIG. 6.

FIGS. 6-8 show a horizontal tubular 17 that is to be repaired. In FIGS. 6-8 a valved line 80 is provided for injecting grout 77 into annulus 74 as shown. Arrows 81 illustrate the gradual rise of grout 77 in annulus 74. In the embodiment of FIGS. 6-8, the clamp assembly 21 is basically the same as the clamp assembly of FIGS. 1-5. The difference is that the clamp assembly 21 extends horizontally along horizontally extending member 17 as shown in FIGS. 6-8. Otherwise, the repair clamp assembly 21 includes central clamp half sections 30, 31 and upper and lower clamp half sections 46-49. Longitudinal seals 82, 83 are shown, each seal 82, 83 being sandwiched between pairs of linear flanges 38-41 of the central clamp half sections 30, 31. In FIGS. 7 and 8, longitudinal ribs 84, 85 can be provided on one or more of the linear flanges 38-41, pressing against a seal 82, 83. The seals 82, 83 can be foam seals saturated with a selected medium such as epoxy material.

Figure 9:
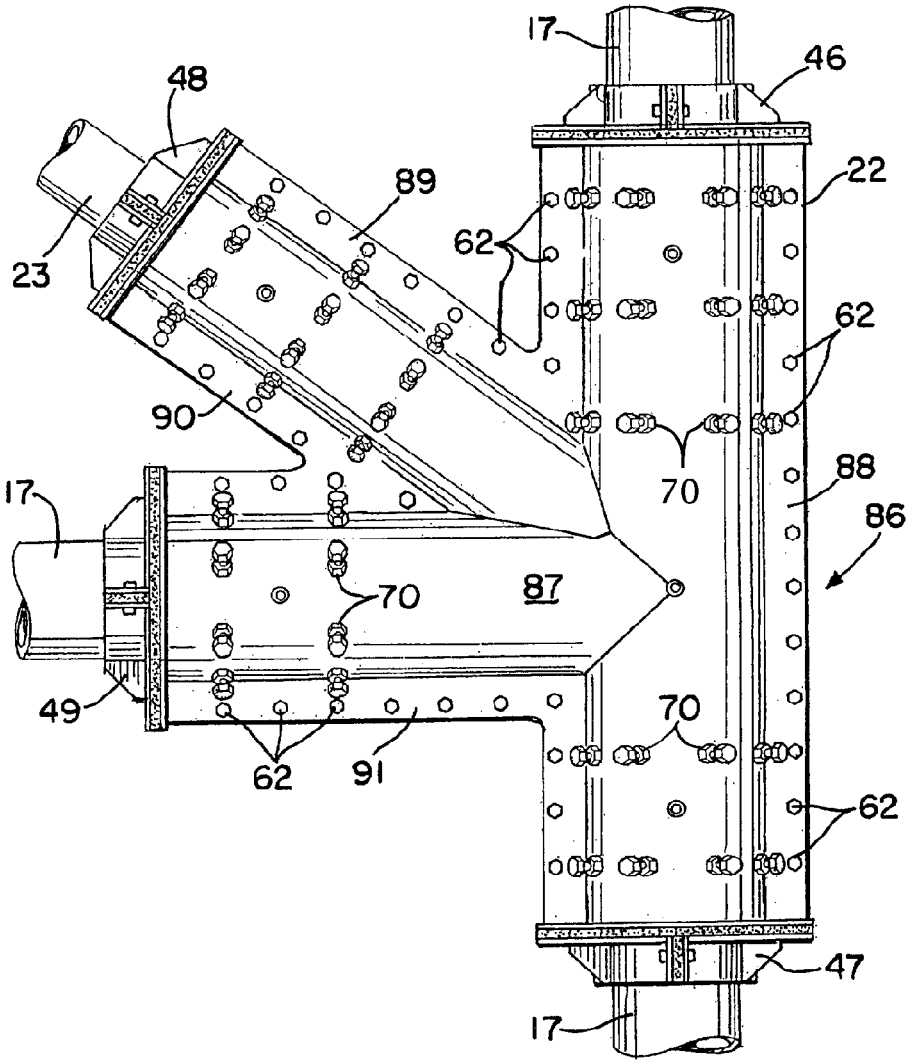
FIG. 9 is a partial elevation view of the preferred embodiment of the apparatus of the present invention illustrating the method of the present invention.

FIGS. 9 and 10 show a K shaped clamp assembly 22. In FIGS. 9 and 10, the clamp assembly 22 includes a pair of clamp half sections 86 that are fastenered together. Each clamp half section 86 includes a curved K shaped part 87 and a plurality of flanges 88-91. The clamp assembly 22 provides fastenered connections, seals, upper and lower clamp half sections 46-49 as with the embodiments of FIGS. 1-8. FIGS. 9 and 10 merely illustrate that the repair system of the present invention can be applied to a K shaped arrangement of horizontal tubular 17 and diagonal horizontal tubulars 23.

Figure 11:
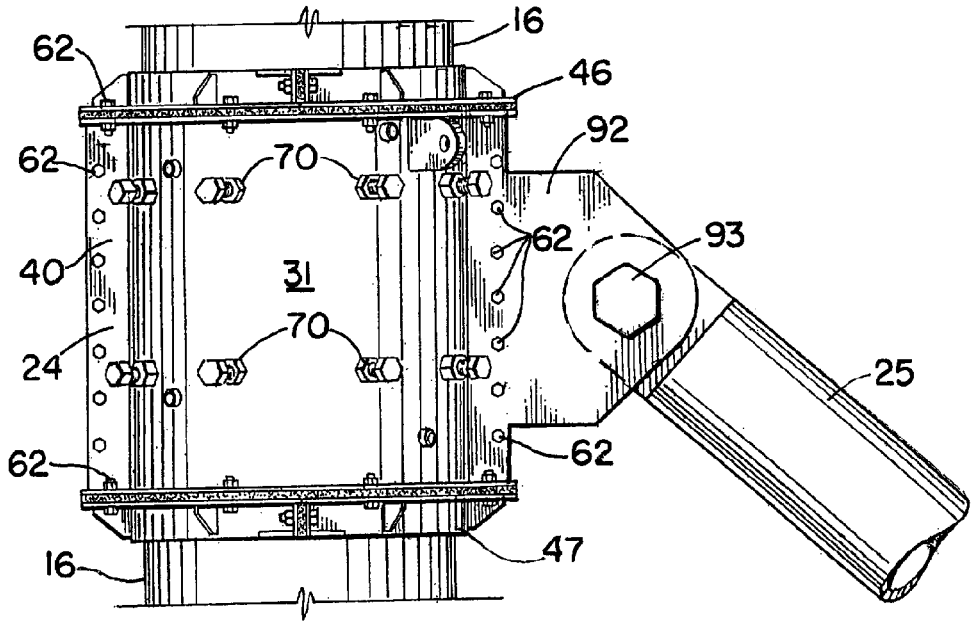
FIG. 11 is a fragmentary view illustrating an alternate construction for the repair of the apparatus of the present invention and illustrating the method of the present invention.
Figure 12:
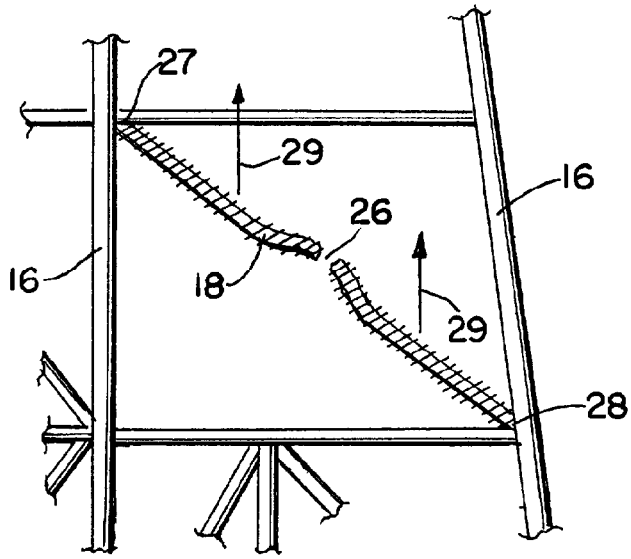
FIGS. 12 and 13 are elevation views illustrating the method of the present invention.
Figure 13:
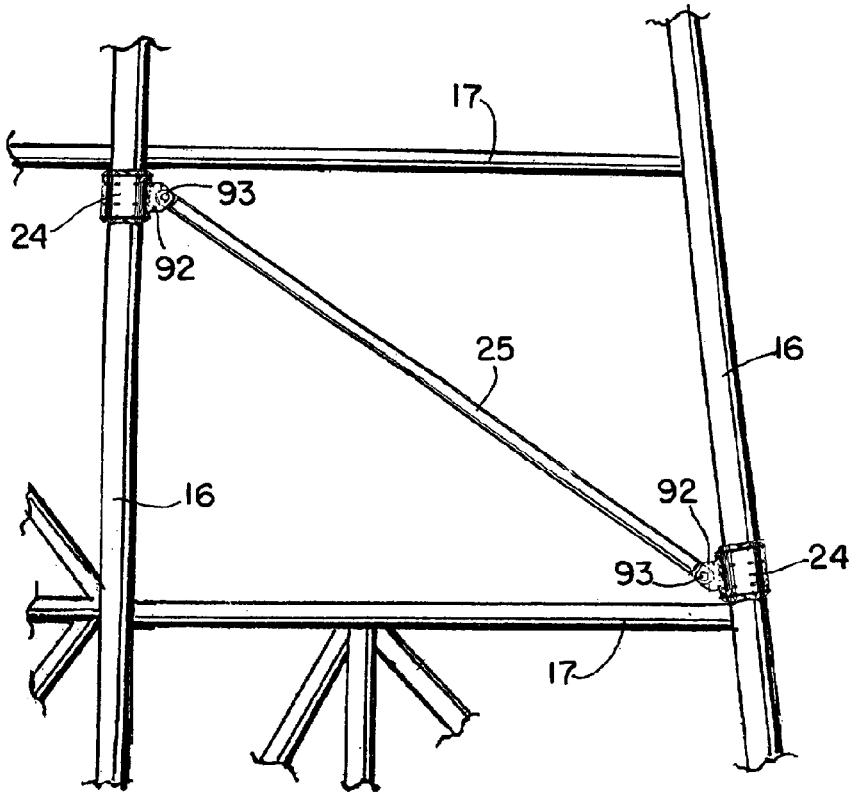
Figure 18:
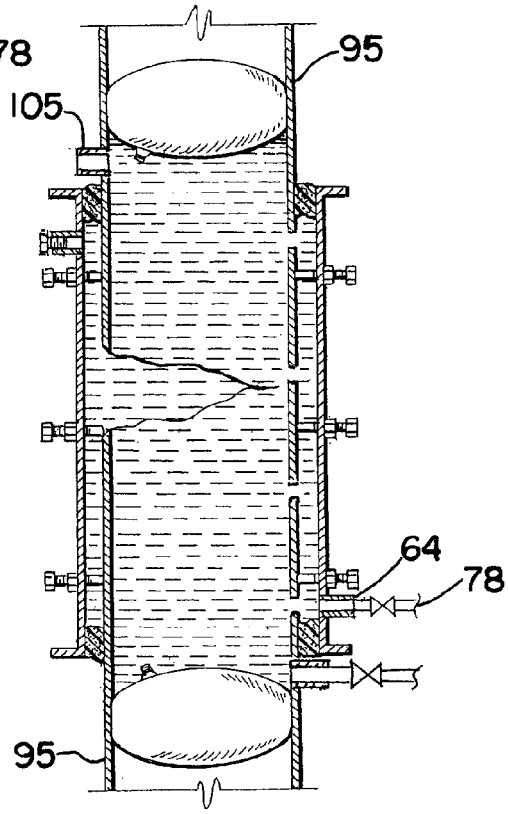

FIGS. 11-13 show a clamp assembly 24 for replacing a damaged diagonal tubular 18. In FIG. 12, the diagonal tubular 18 has a break 26. Cuts are made at 27, 28 for enabling removal (arrow 29) of the damaged diagonal tubular 18. In FIG. 18, a pair of clamp assemblies 24 are placed on long vertical/inclined tubular 16, 17 for supporting a new repair section 25. The clamp 24 of FIGS. 11-12 are shown in more detail in FIG. 11. The clamp 24 is of the same configuration as the clamps of FIGS. 1-8. However, in the clamp assembly 24, the linear flanges 39, 41 are replaced with flanged plates 92.

The flange plates 92 enable a pinned connection 93 to be formed between clamp assembly 24 and the new repair section 25 as shown on FIG. 11.

Figure 16:
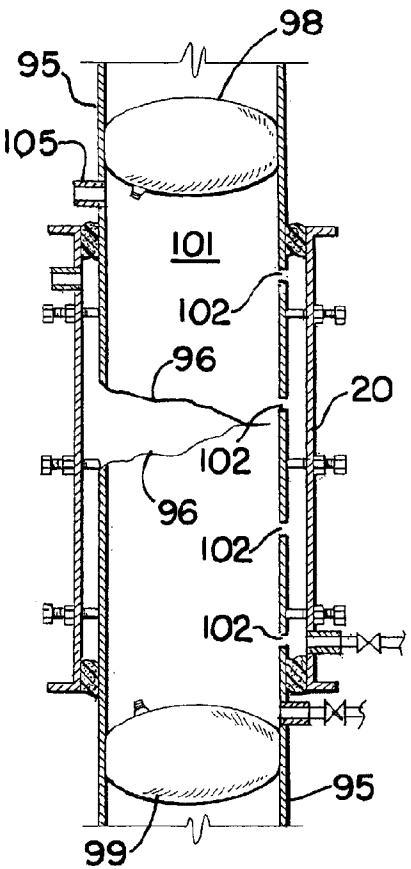
FIGS. 14-18 are sectional elevation views illustrating the method of the present invention.
Figure 15:
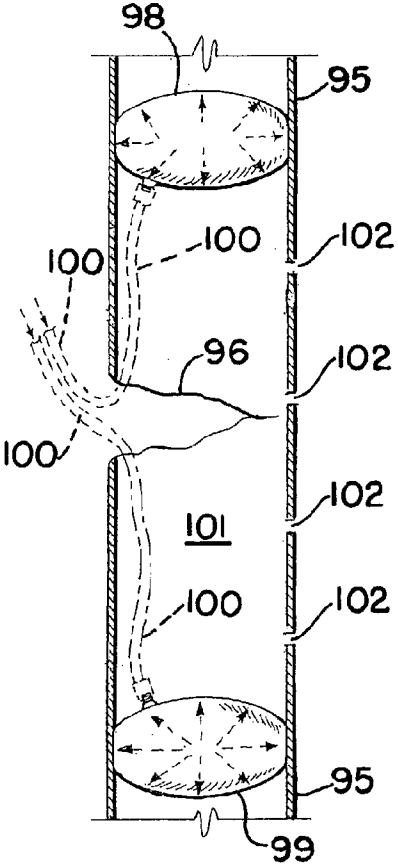
Figure 14:
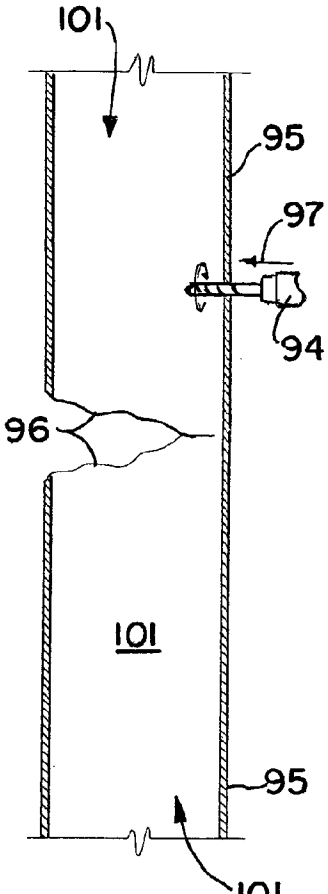
Figure 17:
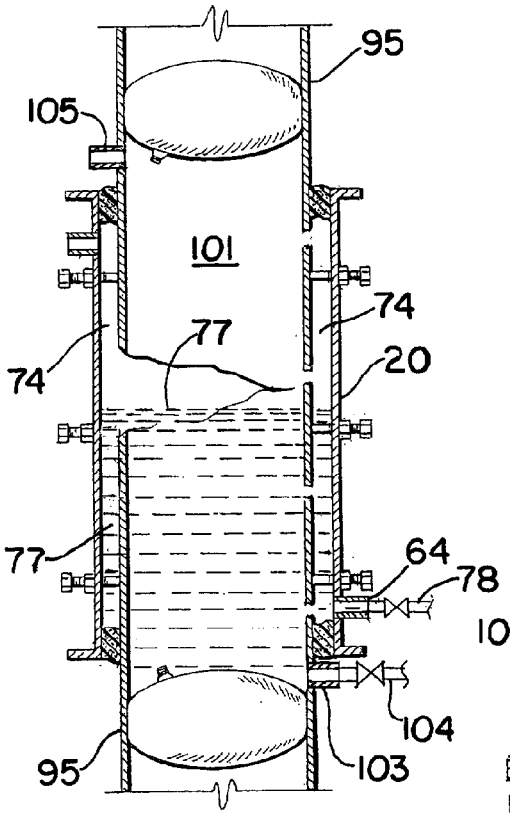

FIGS. 14-18 illustrate the repair of a fractured tubular 95 having a fracture 96. In FIG. 14 a drill 94 is used to drill vertically spaced apart holes 102 as shown in FIGS. 14-16. Arrow 97 illustrates the penetration of the fracture tubular 95 using the drill 94 to drive a drill bit. In FIG. 15, a pair of plugs, pigs, or inflatable seals 98 are place above and below the fracture 96. Air or fluid lines 100 can be used to inflate the members 98, 99. In this fashion, the bore 101 of damaged or fractured tubular 95 is sealed above and below the fracture 96. Clamp assembly 20 is then placed around the damaged member 95 at the fracture 96 as shown in FIG. 16. A tubular influent fitting 103 is attached to the damaged member 95 below clamp assembly 20. A valved flow line 104 is fitted to the tubular influent fitting 103. A vent fitting 105 is fastened to the damaged member 95 above clamp assembly 20 as shown in FIG. 17. In this fashion, grout 77 can be injected not only into the annulus 74 in between the clamp assembly 20 and the member 95 but also into the bore 101 of the damaged member 95 in between the inflatable members 98, 99 as shown in FIGS. 17 and 18.

PARTS LIST

| Part Number | Description |
|---|---|
| 10 | marine tubular repair system |
| 11 | jacket |
| 12 | seabed |
| 13 | water surface |
| 14 | platform |
| 15 | piling |
| 16 | long vertical/inclined tubular member |
| 17 | horizontal tubular member |
| 18 | diagonal tubular member |
| 19 | riser/pipe |
| 20 | clamp assembly |
| 21 | clamp assembly |
| 22 | clamp assembly |
| 23 | diagonal horizontal tubular member |
| 24 | clamp assembly |
| 25 | repair section |
| 26 | break |
| 27 | cut |
| 28 | cut |
| 29 | arrow |
| 30 | central clamp half section |
| 31 | central clamp half section |
| 32 | curved surface |
| 33 | curved surface |
| 34 | upper arcuate flange |
| 35 | lower arcuate flange |
| 36 | upper arcuate flange |
| 37 | lower arcuate flange |
| 38 | linear flange |
| 39 | linear flange |
| 40 | linear flange |
| 41 | linear flange |
| 42 | longitudinal seal |
| 43 | longitudinal seal |
| 44 | seal opening |
| 45 | flange opening |
| 46 | upper clamp half section |
| 47 | lower clamp half section |
| 48 | upper clamp half section |
| 49 | lower clamp half section |
| 50 | arcuate plate |
| 51 | curved plate |
| 52 | end plate |
| 53 | end plate |

-continued

PARTS LIST

| Part Number | Description |
|---|---|
| 54 | opening |
| 55 | opening |
| 56 | upper arcuate seal |
| 57 | lower arcuate seal |
| 58 | seal opening |
| 59 | gusset |
| 60 | end seal |
| 61 | opening |
| 62 | fastenered connection |
| 63 | hinge |
| 64 | injection port |
| 65 | injection port |
| 66 | vent port |
| 67 | vent port |
| 68 | upper curved seal |
| 69 | lower curved seal |
| 70 | threaded fastener |
| 71 | internally threaded fitting |
| 72 | head |
| 73 | inner part |
| 74 | annulus |
| 75 | arrow |
| 76 | arrow |
| 77 | grout |
| 78 | valved line |
| 79 | valved line |
| 80 | valved line |
| 81 | arrow |
| 82 | longitudinal seal |
| 83 | longitudinal seal |
| 84 | longitudinal rib |
| 85 | longitudinal rib |
| 86 | clamp half section |
| 87 | curved K shaped part |
| 88 | flange |
| 89 | flange |
| 90 | flange |
| 91 | flange |
| 92 | flanged plate |
| 93 | pinned connection |
| 94 | drill |
| 95 | fractured tubular |
| 96 | fracture |
| 97 | arrow |
| 98 | upper seal |
| 99 | lower seal |
| 100 | air/fluid line |
| 101 | bore |
| 102 | drilled hole |
| 103 | tubular influent fitting |
| 104 | valved flowline |
| 105 | vent fitting |
| 106 | opening |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of repairing an underwater tubular member having a wall surrounding a bore, comprising the steps of:

a. providing a pair of clamp halves, each of the halves having a pair of longitudinally extending flanges;

b. encapsulating a section of the tubular member with the half section, wherein the pair of flanges of one half section are fastened to the pair of flanges of the other half section;

c. spacing the half section from the tubular member with multiple threaded fasteners that extend through the wall of each half section, each threaded fastener clamping against the underlying tubular member;

d. sealing an annulus between each half section and the tubular member at spaced apart portions;

e. wherein step "d" a seal member is fastened to a clamp half;

f. pumping an epoxy grout into the annulus;

g. wherein the tubular member has a damaged portion with an opening and in step "f" the bore is at least partially filled with epoxy next to said opening; and h. placing bore closures in the bore on opposing sides of the damaged portions and grouting the bore in between the closure members.

2. The method of claim 1 wherein each half section has a pair of arcuate flanges and in step "e" a seal member is fastened to a half section at said arcuate flange.

3. The method of claim 2 wherein the seal member in step "e" comprises a plurality of arcuate seal members, each having an arcuate flange and a curved flange, each arcuate flange fastened to a half section and each curved flange conforming generally to the outer surface of the tubular member.

4. The method of claim 1 wherein there are a plurality of flanged, arcuate seal members and in step "e" the seal member is fastened to a half section.

5. The method of claim 1 wherein the epoxy is bonded to the tubular member and clamp halves in step "f".

6. The method of claim 5 wherein the epoxy bonds to the threaded fasteners.

7. The method of claim 1 wherein the clamp halves have a K shape.

8. The method of claim 1 further comprising seal elements placed in between the flanges of different halves.

9. The method of claim 1 wherein the tubular member bore and the annulus are both grouted.

10. The method of claim 1 wherein shear bond strength between the member and the clamp is between 50 and 500 p.s.i.

11. The method of claim 1 wherein the clamping force of the threaded fastener against the member is in the range of between about 10 and 70 percent yield strength of the fastener.

12. The method of claim 11 wherein the clamping force of the threaded fastener against the member is maintained for a time period of between about 1 and 7 days.

13. The method of claim 11 wherein the clamping force of the threaded fastener against the member is maintained for a time period of between about 1 and 30 days.

14. The method of claim 11 wherein the clamping force of the threaded fastener against the member is maintained for a time period of between about 1 and 100 years.

15. The method of claim 1 wherein the clamping force of the threaded fastener against the member is in the range of between about 20 and 70 percent yield strength of the fastener.

16. The method of claim 1 wherein the clamping force of the threaded fastener against the member is in the range of between about 30 and 70 percent yield strength of the fastener.

17. A method of repairing an underwater tubular member having a wall surrounding a bore, comprising the steps of:

a. providing a pair of clamp halves, each of the halves having a pair of longitudinally extending flanges;

b. encapsulating a section of the tubular member with the half section, wherein the pair of flanges of one half section are fastened to the pair of flanges of the other half section;

c. spacing the half section from the tubular member with multiple threaded fasteners that extend through the wall of each half section, each threaded fastener clamping against the underlying tubular member;

d. sealing an annulus between each half section and the tubular member at spaced apart portions;

e. wherein step "d" a seal member is fastened to a clamp half;

f. pumping an epoxy grout into the annulus; and g. wherein the tubular member bore and the annulus are both grouted.

18. A method of repairing an underwater tubular member having a wall surrounding a bore, comprising the steps of:

a. providing a pair of clamp halves, each of the halves having a pair of longitudinally extending flanges;

b. encapsulating a section of the tubular member with the half section, wherein the pair of flanges of one half section are fastened to the pair of flanges of the other half section;

c. spacing the half section from the tubular member with multiple threaded fasteners that extend through the wall of each half section, each threaded fastener clamping against the underlying tubular member;

d. sealing an annulus between each half section and the tubular member at spaced apart portions;

e. wherein step "d" a seal member is fastened to a clamp half;

f. pumping an epoxy grout into the annulus; and g. wherein the tubular member has a damaged portion with an opening and in step "f" the bore is at least partially filled with epoxy next to said opening;

h. wherein the tubular member bore and the annulus are both grouted; and i. wherein the wall of the tubular member is drilled to accept a grout injection port.

19. The method of claim 18 wherein a clamp half has a grout injection port which enables grouting of the annulus in between the clamp halves and the members.

20. The method of claim 18 wherein the tubular member grout injection port is next to a bore closure member.

21. A method of repairing an underwater tubular member having a wall surrounding a bore, comprising the steps of:

a. providing a pair of clamp halves, latch halves having a pair of longitudinally extending flanges;

b. encapsulating a section of the tubular member with the half section, wherein the pair of flanges of one half section are fastened to the pair of flanges of the other half section;

c. spacing the half section from the tubular member with multiple threaded fasteners that extend through the wall of each half section, each threaded fastener clamping against the underlying tubular member;

d. sealing an annulus between each half section and the tubular member at spaced apart portions;

e. wherein step "d" a seal member is fastened to a clamp half;

f. pumping an epoxy grout into the annulus;

g. wherein the tubular member has a damaged portion with an opening and in step "f" the bore is at least partially filled with epoxy next to said opening; and h. wherein the tubular member is drilled to accept a grout injection port bore.

22. The method of claim 21 wherein shear bond strength between the member and the clamp is between 50 and 500 p.s.i.

* * * * *